US007887352B2

(12) United States Patent
Tamagawa et al.

(10) Patent No.: US 7,887,352 B2
(45) Date of Patent: Feb. 15, 2011

(54) ELECTRIC-WIRE BUNDLE WITH WATER-PROOFING CONNECTOR

(75) Inventors: Tatsuo Tamagawa, Yokkaichi (JP); Hiroki Hirai, Yokkaichi (JP); Tetsuji Tanaka, Yokkaichi (JP); Hiroomi Hiramitsu, Yokkaichi (JP)

(73) Assignees: Autonetworks Technologies, Ltd., Mie (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 12/734,975

(22) PCT Filed: Dec. 16, 2008

(86) PCT No.: PCT/JP2008/072882

§ 371 (c)(1),
(2), (4) Date: Jun. 7, 2010

(87) PCT Pub. No.: WO2009/078414

PCT Pub. Date: Jun. 25, 2009

(65) Prior Publication Data

US 2010/0267280 A1 Oct. 21, 2010

(30) Foreign Application Priority Data

Dec. 18, 2007 (JP) ..... 2007-326181

(51) Int. Cl.
*H01R 13/52* (2006.01)

(52) U.S. Cl. ..... 439/275

(58) Field of Classification Search ..... 439/274, 439/275, 587, 589, 279, 877
See application file for complete search history.

(56) References Cited

U.S. PATENT DOCUMENTS 5,931,699 A * 8/1999 Saito ..... 439/587

(Continued)

FOREIGN PATENT DOCUMENTS

JP A-8-138795 5/1996

(Continued)

OTHER PUBLICATIONS

International Search Report mailed on Mar. 17, 2009 in corresponding International Application No. PCT/JP2008/072882.

*Primary Examiner*—Phuong K Dinh
(74) *Attorney, Agent, or Firm*—Oliff & Berridge, PLC

(57) ABSTRACT

A connector-equipped electric-wire bundle including a plurality of types of electric wires different in conductor cross-sectional area and elongation. The connector-equipped electric-wire bundle comprises a first electric wire having a first conductor, and a second electric wire having a second conductor with a greater cross-sectional area and a greater breaking elongation than those of the first conductor. A second connector terminal having, as a second crimp portion, only a conductor barrel and a water-proofing-plug barrel is attached to an end of the second electric wire, and a first connector terminal having, as a first crimp potion, a conductor barrel, a water-proofing-plug barrel and an intermediate barrel is attached to an end of the first electric wire. The intermediate barrel is crimped onto an insulating cover in an intermediate region between the end of the conductor of the first electric wire and a water-proofing plug.

7 Claims, 9 Drawing Sheets

U.S. PATENT DOCUMENTS

| | | | | |
|---|---|---|---|---|
| 6,071,147 | A * | 6/2000 | Tsukamoto | 439/587 |
| 6,174,201 | B1 * | 1/2001 | Murakami et al. | 439/587 |
| 7,036,226 | B2 | 5/2006 | Saito et al. | |
| 7,695,330 | B2 * | 4/2010 | Noda et al. | 439/877 |
| 2004/0221634 | A1 | 11/2004 | Saito et al. | |
| 2006/0035533 | A1 | 2/2006 | Yamano et al. | |

FOREIGN PATENT DOCUMENTS

| | | |
|---|---|---|
| JP | A-2001-297632 | 10/2001 |
| JP | A-2004-248409 | 9/2004 |
| JP | A-2006-66388 | 3/2006 |
| JP | A-2007-250530 | 9/2007 |

* cited by examiner

ELECTRIC-WIRE BUNDLE WITH WATER-PROOFING CONNECTOR

BACKGROUND OF THE INVENTION

1. Field of the Invention

The present invention relates to a connector-quipped electric-wire bundle comprising a plurality of electric wires and a connector provided on ends of the electric wires, and having a waterproof function.

2. Description of Related Art

As a water-proofing connector-equipped electric-wire bundle, there has been conventionally known a type disclosed in FIGS. 1 and 2 of JP 8-138795A. This type of electric-wire bundle comprises a plurality of electric wires and a connector, the connector having a plurality of connector terminals and a housing for holding the connector terminals. Each of the electric wires has an end portion where an insulating cover is removed to locally expose a conductor, and a portion rearward of the end portion to which a water-proofing plug made of pliable material, such as rubber, is attached; the connector terminal is attached across the water-proofing plug and the exposed portion of the conductor. The water-proofing plug has an periphery to make close contact with an inner surface of the housing, the close contact bringing an inside of the connector housing into a watertight state.

Each of the connector terminals has a conductor barrel to be crimped onto the conductor so as to enfold the exposed portion of the conductor from the outside, and a water-proofing-plug barrel to be crimped onto the periphery of the water-proofing plug in such a manner as to enfold the water-proofing plug from the outside. Thus crimping the conductor barrel to the conductor brings the conductor and the connector terminal into electrical conduction to each other. The water-proofing-plug barrel is crimped onto the water-proofing plug to restrain a mechanical load, particularly, a bending load, from acting on a section where the conductor barrel is crimped.

However, not all electric-wire bundles include same electric wires in terms of type or size; not a few electric-wire bundles include electric wires different from each other in type or size. Thus mixed wires possibly have a significant influence on mechanical characteristics, particularly, a tensile strength characteristic, of the entire connector-equipped electric-wire bundle.

Specifically, in the case of an electric-wire bundle which includes, as the above electric wires, a type of having a conductor with a small cross-sectional area and a small elongation occurring when it will have been broken under tensile load (breaking elongation), e.g., signal wire, and a type having a conductor with a large cross-sectional area and a large breaking elongation, e.g., power wire, a tensile load imposed to the entire electric-wire bundle will be ultimately concentrated on the electric wire having the relatively small breaking elongation. Moreover, this tensile load will be concentrated on a portion where the conductor is crimped to make its cross-sectional area be less than that of the other conductor. Therefore, even if the electric-wire bundle includes many electric wires, a tensile strength of the entire electric-wire bundle depends on a tensile strength (a minimum value of a tensile load enough to cause a pull-out or a breakage in a conductor-crimp portion of the electric wires) of a part of the electric wires having a relatively small breaking elongation, which may significantly deteriorate a tensile strength characteristic of the electric-wire bundle.

Particularly, recently used is an electric wire having a high tensile strength in spite of a small sectional area, such as, a wire having a conductor formed by twisting a plurality of strand elemental wires made of cupper around a center elemental wire made of stainless steel, or a conductor made of copper alloy having a tensile strength greater than that of copper. A breaking elongation of such a conductor is significantly small as compared with conductors of regular electric wires.

SUMMARY OF THE INVENTION

It is an object of the present invention to provide a connector-equipped electric electric-wire bundle including a plurality of types of electric wires different in conductor cross-sectional area and elongation while being allowed to have a high tensile strength of the entire electric-wire bundle. For this purpose, the inventers of the present invention focused on a phenomenon specific to the aforementioned water-proofing connector-equipped electric-wire bundle: in the case of attaching a connector terminal having a conductor-crimp portion (e.g., conductor barrel) to be crimped onto a conductor at an end of an electric wire and a water-proofing plug-crimp portion (e.g., water-proofing-plug barrel) to be crimped onto a water-proofing plug to an end portion of the electric wire, the actual breaking elongation is significantly lower than a breaking elongation of the electric wire itself (i.e., an elongation occurring in the electric wire when the wire under tensile load will have reached a breakage). That is probably because the water-proofing-plug barrel crimped onto the water-proofing plug simply enfolds the electric wire through the water-proofing plug, making no contribution to an improved tensile strength and letting a tensile load to be transmitted directly to a portion where the conductor barrel is crimped onto the center conductor. Effectively relieving such concentration of the tensile load to the crimped portion of the conductor in an electric wire having a relatively small elongation will permit the tensile strength characteristic of the entire electric-wire bundle to be sufficiently improved.

The present invention has been made based on the above viewpoint. A water-proofing connector-equipped electric-wire bundle of the present invention comprises: a plurality of electric wires each having a water-proofing conductor and an insulating cover covering the conductor while being locally removed at an end of each of the electric wires; a plurality of water-proofing plugs each being made of material more pliable than the insulating cover at least in an periphery thereof and attached to a vicinity of the end of each of the electric wires so as to surround the insulating cover of the electric wire; a plurality of connector terminals each having a crimp portion crimped onto at least the end of each of the electric wires and the water-proofing plug attached to the electric wire; and a connector housing collectively holding the connector terminals while closely contacting peripheries of the water-proofing plugs onto which the respective connector terminals are crimped. The electric wires include a first electric wire having a first conductor and a second electric wire having a second conductor with a larger cross-sectional area and a greater breakage elongation which is an elongation occurring when the first conductor will have been broken under tensile load than a cross-sectional area and an elongation of the first conductor respectively. The connector terminals include a first connector terminal attached to the first electric wire and a second connector terminal attached to the second electric wire. The second connector terminal has, as the crimp portion, a second crimp portion including only a second-conductor crimp portion crimped onto the second conductor in the insulating cover-removed end of the second electric wire so as to enfold the second conductor and a water-proofing plug-crimp portion crimped onto the water-proofing plug attached to the second electric wire so as to enfold the water-proofing plug. The water-proofing plug is attached to the first electric wire at such a position that an intermediate region where the insulating cover is exposed is ensured between the insulating cover-removed end of the first electric wire and a portion of the first electric wire onto which the water-proofing plug is attached. The first connector terminal has, as the crimp portion, a first crimp portion including a first conductor-crimp portion crimped onto the first conductor in the insulating cover-removed end of the first electric wire so as to enfold the first conductor, a water-proofing plug-crimp portion crimped onto the water-proofing plug attached to the first electric wire so as to enfold the water-proofing plug, and an intermediate crimp portion crimped onto the insulating cover in the intermediate region of the first electric wire so as to enfold the insulating cover.

In the above electric-wire bundle, even if the cross-sectional area and the breaking elongation, which is an elongation occurring when the electric-wire will have been broken under tensile load, of the first conductor constituting the first electric wire is less than the cross-sectional area and the breaking elongation, which is an elongation occurring when the second conductor will have been broken under tensile load, of the second conductor constituting the second electric wire, the intermediate crimp portion included in the first connector terminal attached to the first electric wire improves the breaking elongation of the first electric wire, thereby improving a tensile strength of the entire electric-wire bundle. In other words, equalization between the elongations of the respective electric wires enables the tensile strength of the entire electric-wire bundle to be improved with a low cost structure.

BRIEF DESCRIPTION OF THE DRAWINGS

FIG. 3 shows a state after a first connector terminal is attached to the first electric wire, wherein

FIG. 4 shows the first connector terminal in a state before a crimping operation, wherein

DESCRIPTION OF THE PREFERRED EMBODIMENT

With reference to the drawings, a preferred embodiment of the present invention will be described.

Figure 1:
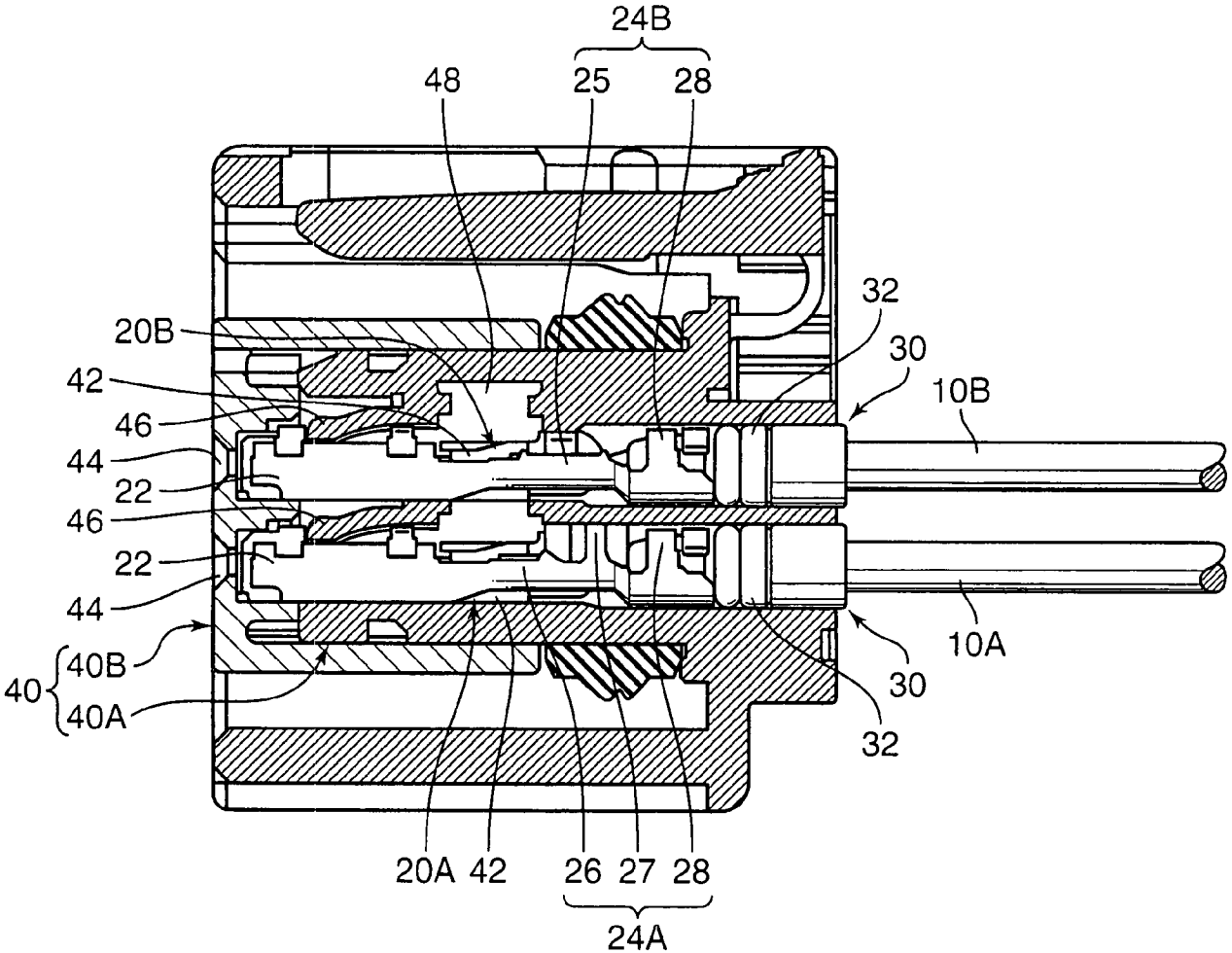
FIG. 1 is a sectional front view showing an internal structure of a connector in a connector-equipped electric-wire bundle according to an embodiment of the present invention.

FIG. 1 is a sectional front view showing an internal structure of a connector in a connector-equipped electric-wire bundle according to this embodiment. This connector-equipped electric-wire bundle comprises: a plurality of electric wires including a first electric wire 10A and a second electric wire 10B; a first connector terminal 20A attached to the first electric wire 10A; a second connector terminal 20B attached to the second electric wire 10B; water-proofing plugs 30 attached to the electric wires 10A and 10B respectively, and a connector housing 40 collectively holding the connector terminals 20A and 20B. The connector housing 40 and the connector terminals 20A and 20B make up a connector.

Figure 2B:
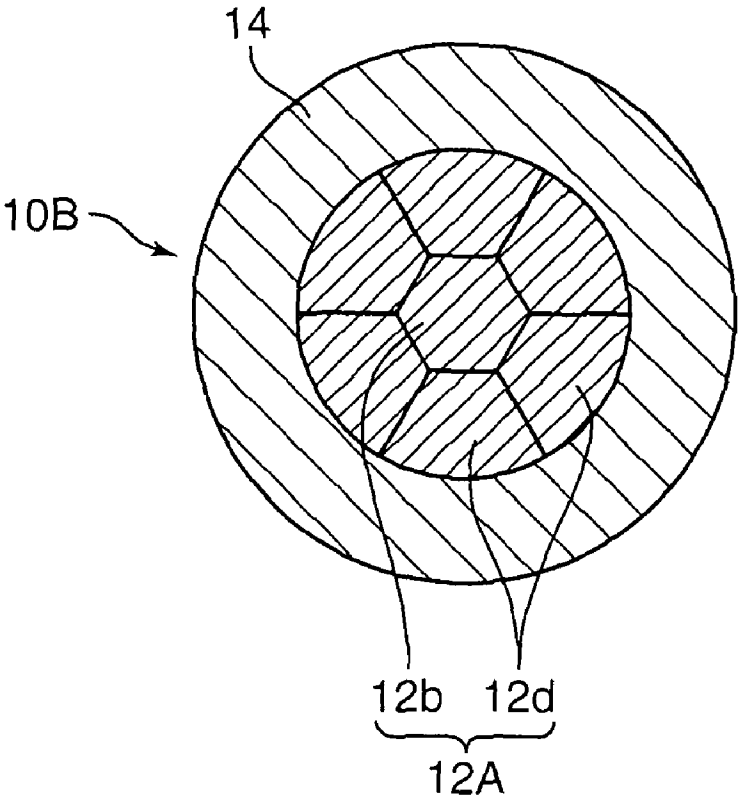
FIGS. 2A and 2B are sectional views showing examples of a structure of a first electric wire included in the connector-equipped electric-wire bundle.
Figure 2A:
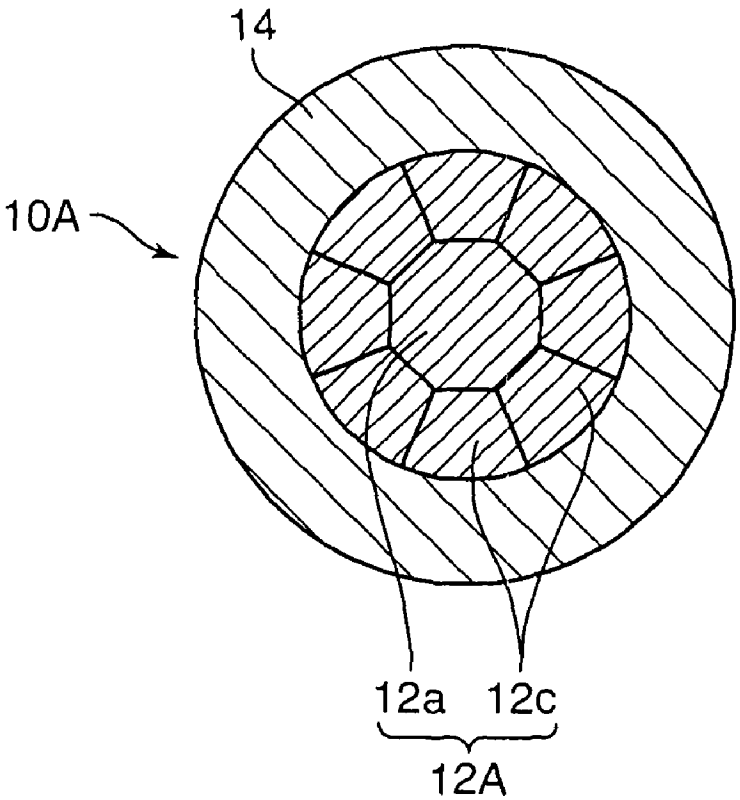
Figure 3A:
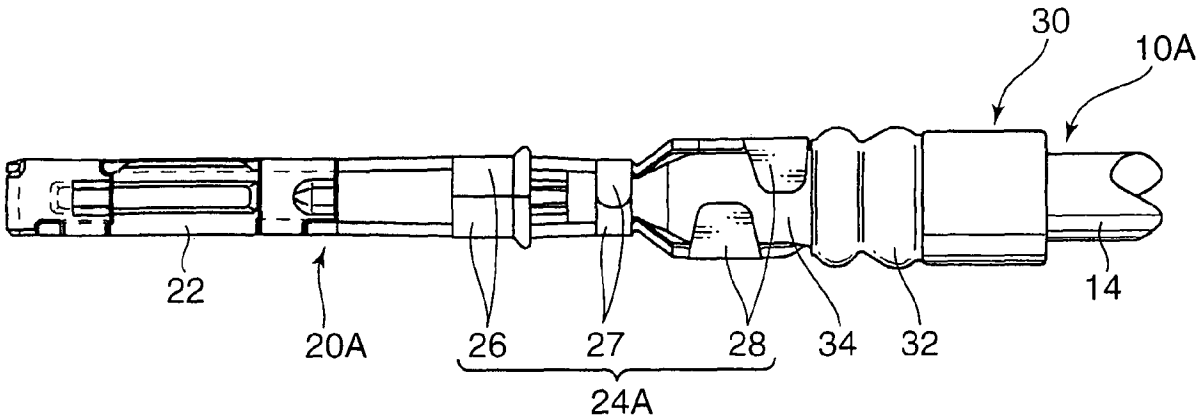
FIG. 3A, FIG. 3B and FIG. 3C are a top plan view, a side view and a front view, respectively.
Figure 3C:
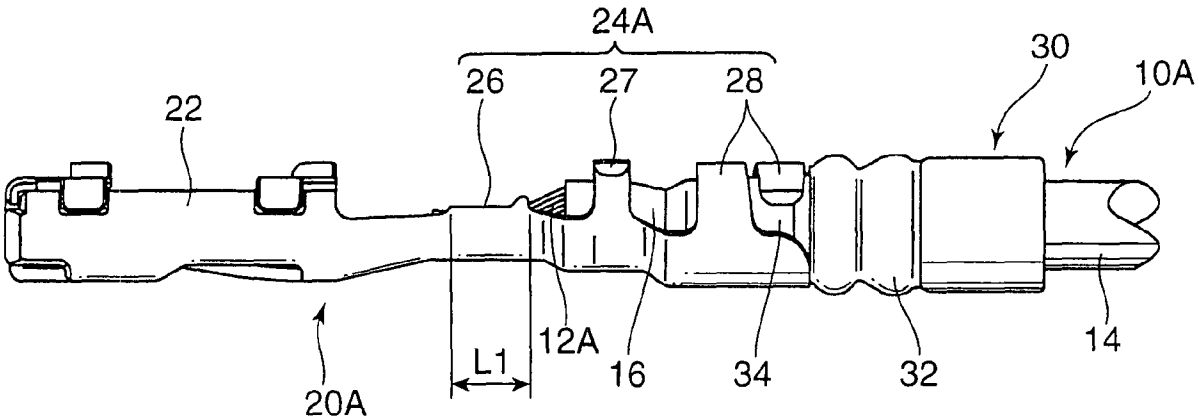
Figure 3B:
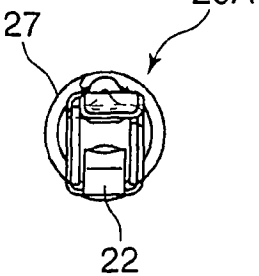

As shown in FIG. 2A and FIG. 3, the first electric wire 10 comprises a first conductor 12A, and an insulating cover 14 covering a periphery of the first conductor 12A. In this embodiment, the first conductor 12A is made up of a center elemental wire 12*a* formed of stainless steel and a plurality of strand elemental wires 12*c* twisted around the center elemental wire 12*a*, as shown in FIG. 2A, to ensure a high tensile strength yet with a small cross-sectional area. The insulating cover 14 is formed of resin material having high insulating performance, such as polypropylene, polyethylene or polyvinyl chloride, a portion of the insulating cover in an end of the electric wire being removed to thereby expose the first conductor 12A locally at the end.

As another suitable example, the first conductor 12A may comprise a center elemental wire 12*b* and a plurality of strand elemental wires 12*d* each formed of copper alloy, as shown in FIG. 2B. As the Cu-based alloy, suitable is, for example, one containing 0.3 wt % of Sn.

Figure 6:
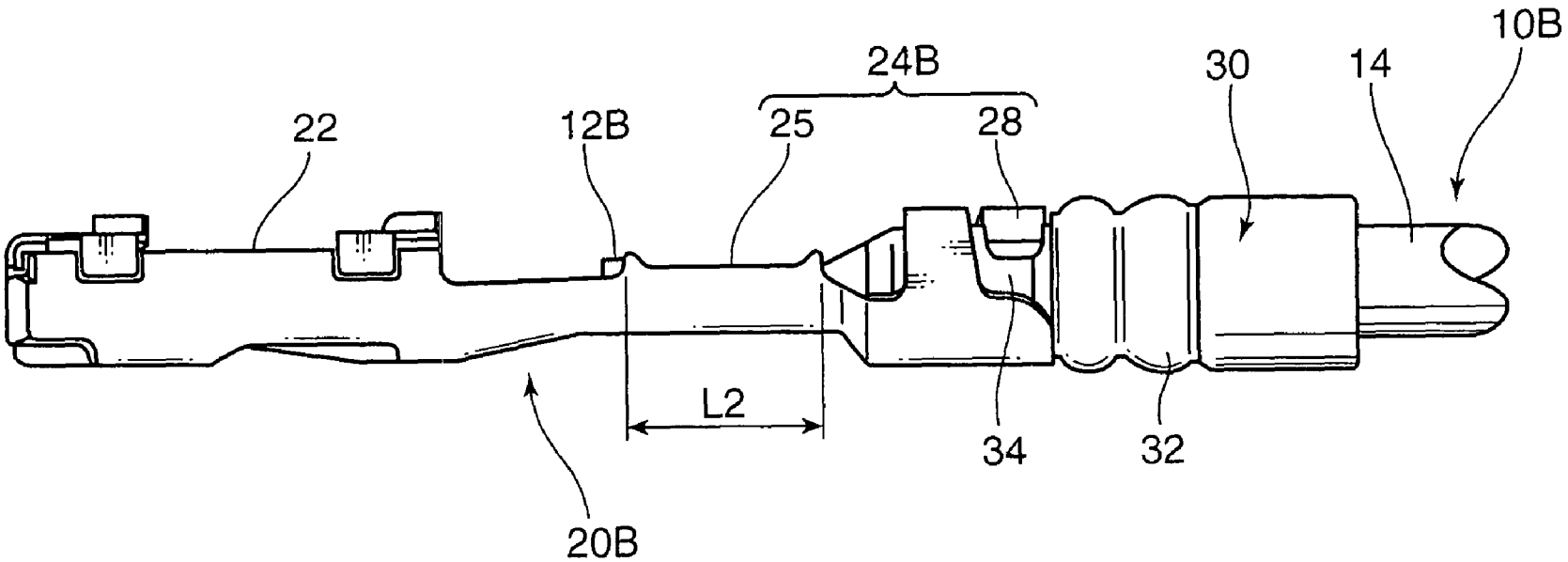
FIG. 6 is a front view showing a state after a second connector terminal is attached to a second first electric wire.

As shown in FIG. 6, the second electric wire 10B comprises a second conductor 12B, and an insulating cover 14 covering a periphery of the second conductor 12B. The second conductor 12B has a cross-sectional area greater than that of the first conductor 12A, formed of material with an elongation when the conductor will have been broken under tensile load (breaking elongation) greater than that of the first conductor 12A. Specifically, used in this embodiment is a conductor wherein the center elemental wire and the strand elemental wires twisted around the center elemental wire are made of copper (soft copper). The second conductor 12B may be formed of a single elemental wire. It is essential that the materials of the first and second conductors 12A and 12B can be freely selected as long as the breaking elongation of the second conductor 12B is greater than the breaking elongation of the first conductor 12A.

The water-proofing plugs 30 attached to the respective electric wires 10A and 10B are common. The water-proofing plug 30 is formed of material more pliable than that of the insulating cover 14, such as a rubber material including silicon-based rubber, into a tubular shape. In an outer peripheral surface of an axially intermediate portion of the water-proofing plug, there is formed a sealing portion 32 constituted by a circumferentially-extending protrusion having a maximum outer diameter greater than that of a remaining portion of the water-proofing plug.

Each the water-proofing plugs 30 is attached to each of the electric wires 10A and 10B involving full surface contact between the water-proofing plug 30 and outer peripheral surface of the insulating covers 14, by inserting the electric wires 10A and 10B into respective inner holes of the water-proofing plugs 30 without a gap therebetween. However, the positions where the water-proofing plugs 30 are attached to the first electric wire 10A and the second electric wire 10B respectively are different from each other in an axial direction of the electric wire.

Specifically, the position where the water-proofing plug 30 is attached to the first electric wire 10A is set to such a position that a front edge of the water-proofing plug 30 is rearwardly away from the insulating cover-removed end of the first electric wire 10A by a given distance. In other words, the water-proofing plug 30 is attached so as to ensure an intermediate region 16 having an axial size equal to the given distance between the insulating cover-removed end and the front edge of the water-proofing plug 30, exposing the outer peripheral surface of the insulating cover 14 in the intermediate region 16. In contrast, the position where the water-proofing plug 30 is attached to the second electric wire 10B is set to a position immediately rearward of the insulating cover-removed end of the second electric wire 10B.

Each of the first connector terminal 20A and the second connector terminal 20B is formed by punching a metal plate of high electrical conductivity into an appropriate shape and bending the obtained plate. The first connector terminal 20A has an electrical contact portion 22 adapted to be fitted to a counterpart terminal and a first crimp portion 24A located rearward of the electrical contact portion. The second connector terminal 20B has a similar electrical contact portion 22 and a second crimp portion 24B located rearward of the electrical contact portion 22.

In this embodiment, the electrical contact portion 22 of each of the terminals 20A and 20B is formed into a female form (box-shaped form) adapted to be fitted with a male-type counterpart terminal, containing a spring piece formed so as to make elastic pressure contact with the counterpart terminal. The present invention, however, permits the electrical contact portion 22 to be formed also in a male-type.

The first crimp portion 24A of the first connector terminal 20A has a pair of conductor barrels (first conductor-crimp portion) 26 adapted to be crimped onto the first conductor 12A at the end of the first electric wire 10A, a pair of water-proofing-plug barrels (water-proofing plug-crimp portion) 28 adapted to be crimped onto the water-proofing plug 30 attached to the first electric wire 10A, and a pair of intermediate barrels (intermediate crimp portion) 27 located between respective pairs of barrels 26 and 28 to be crimped onto the insulating cover 14 in the intermediate region 16.

Figure 4A:
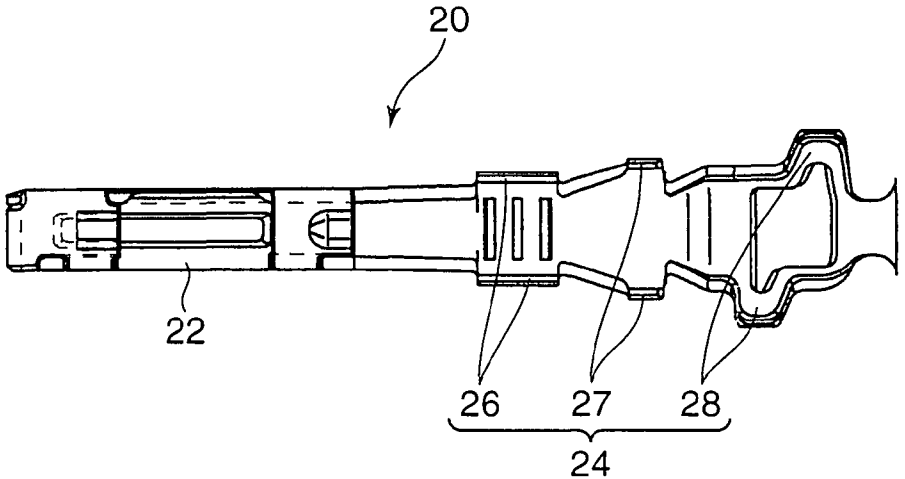
FIG. 4A, FIG. 4B and FIG. 4C are a top plan view, a side view and a front view, respectively.
Figure 4C:
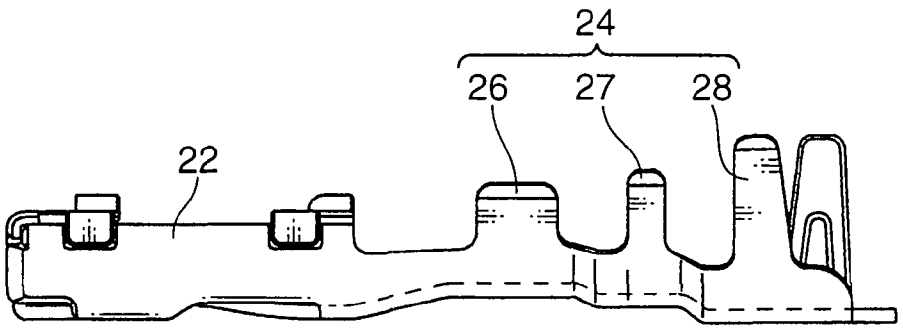
Figure 4B:
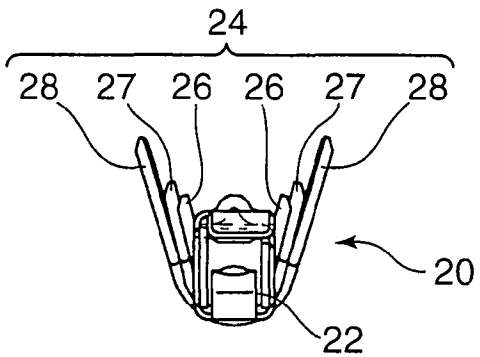
Figure 5A:
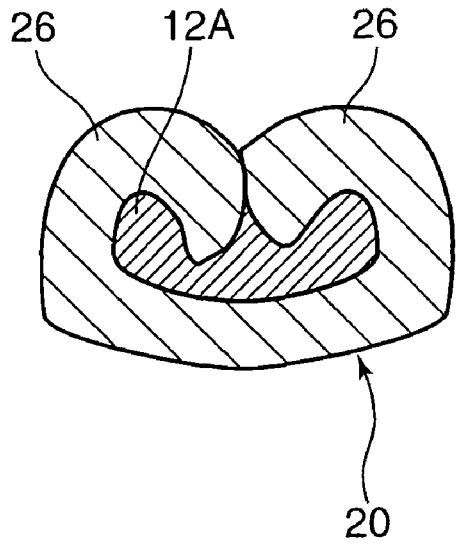
FIG. 5A is a sectional front view showing a crimped portion where a conductor barrel of the first connector terminal is crimped onto a conductor of the first electric wire.

Each of the barrels 26, 27 and 28 has a shape of extending from a right or left side of a basal portion of the connecter terminal extending in its axial direction, obliquely upwardly and outwardly, in a state before crimped onto the electric wire 10 as shown in FIGS. 4A to 4C, As shown in FIG. 5A, the conductor barrels 26 are bent into a shape of enfolding the first conductor 12A such that distal ends of the conductor barrels 26 are bitten into the first conductor 12A. The thus bent conductor barrels 26 are crimped onto the first conductor 12A so as to ensure a sufficient electrical conduction state between the first conductor 12A and the pair of conductor barrels 26.

The water-proofing-plug barrels 28 are bent into a shape of enfolding the water-proofing plug 30 so as to be offset to each other in the axial direction, thus crimped onto the water-proofing plug 30. In the illustrated embodiment, a distance between the water-proofing-plug barrels 28 and the conductor barrels 26 is set so that the water-proofing-plug barrels 28 are crimped at a position frontward of the sealing portion 32.

Figure 5B:
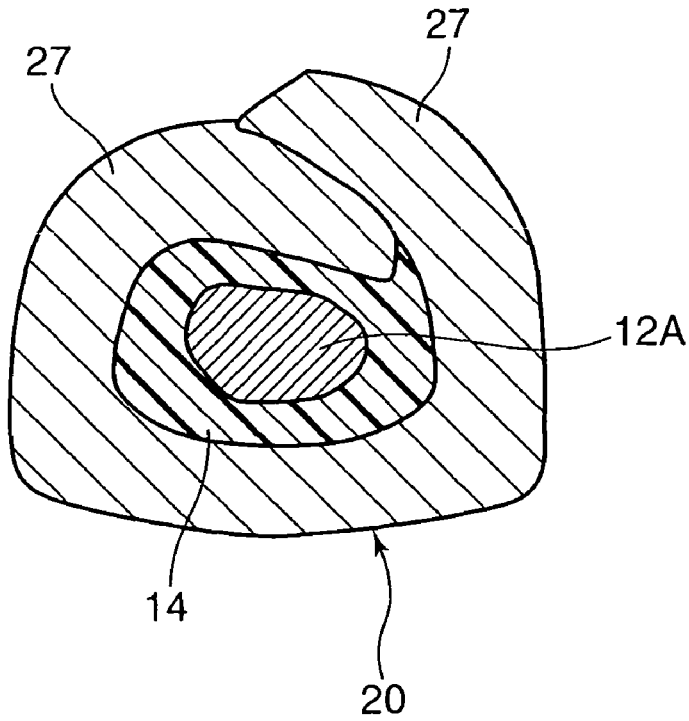
FIG. 5B is a sectional front view showing a crimped portion where an intermediate barrel of the first connector terminal is crimped onto an insulating cover in an intermediate region of the first electric wire.

As also shown in FIG. 5B, the intermediate barrels 27 are bent into a shape of enfolding the insulating cover 14 in the intermediate region 16 in such a manner that a distal end of one of the intermediate barrels 27 is superimposed on a distal end of the other intermediate barrel 27, thus crimped onto the insulating cover 14 in the intermediate region 16.

The material of the insulating cover 14 onto which the intermediate barrels 27 are crimped is harder than the water-proofing plug 30 onto which the water-proofing-plug barrels 28 is crimped; this allows the intermediate barrels 27 to be crimped onto the insulating cover 14 with a strength greater than the strength with which the water-proofing-plug barrels 28 are crimped onto the water-proofing plug 30. In addition, the intermediate barrels 27, directly crimped onto the insulating cover 14 constituting the electric wire 10 differently from the water-proofing-plug barrels 28, effectively restrain a tensile load (particularly, shock load) acting on the electric wire 10 from being transmitted to the portion of the first electric wire 12A onto which portion the conductor barrels 26 are crimped.

The second crimp portion 24B included in the second connecter terminal 20B comprises, as shown in FIG. 6, only a pair of conductor barrels (second conductor-crimp portion) 25 adapted to be crimped onto the second conductor 12B in the end of the second electric wire 10B, and a pair of water-proofing-plug barrels (water-proofing plug-crimp portion) 28 adapted to be crimped onto the water-proofing plug 30 attached to the second electric wire 10B, not including ones corresponding to the intermediate barrels 27. The pair of conductor barrels 25, having a cross-sectional shape similar to that of the pair of conductor barrels 26 of the first crimp portion 24A, are crimped onto the second conductor 12B of the second electric wire 10B similarly to the conductor barrels 26. The water-proofing-plug barrels 28, which are similar to the water-proofing-plug barrels 28 of the first crimp portion 24A, are crimped onto the water-proofing plug 30 attached to the second electric wire 10B so as to enfold the water-proofing plug 30 from the outside.

In this embodiment, the second connector terminal 20B, where an intermediate barrels (intermediate crimp portion) is omitted, is given an axial size L2 (FIG. 6) of each of the conductor barrels 25 greater than an axial size L1 (FIG. 3C) of each of the conductor barrels 26 of the first connector terminal 20A, by the omitted intermediate barrels. The thus given size provides the conductor barrels 25 with a retaining force enough to retain the second conductor 12B having a cross-sectional area greater than that of the first conductor 12A, and allows an axial overall length of the first connector terminal 20A having the intermediate barrels 27 and an axial overall length of the second connector terminal 20B with no intermediate barrels to be equalized to each other. In the illustrated embodiment, the terminals 20A and 20B have overall lengths equal to each other.

The connector housing 40 is molded of insulating material into a shape capable of collectively holding the first connector terminal 20A and the second connector terminal 20B. Specifically, the connector housing 40 comprises a housing body 40A having cavities 42 allowing the connector terminals 20A and 20B and the water-proofing plugs 30 onto which the respective connector terminals 20A and 20B are crimped to be inserted thereinto, and a cover 40B covering the housing body 40A from a front side thereof, the cover 40B provided with terminal insertion holes 44 into which respective counterpart terminals can be inserted. The housing body 40A has an inner surface surrounding each of the cavities 42, from which surface a lance 46 extends frontwardly and obliquely to lock the electrical contact portion 22 of a corresponding one of the connector terminals 20A and 20B, and a retainer 48 is attached at a position rearward of the lance 46 to double-lock the electrical contact portion 22.

Each of the water-proofing plugs 30 of the terminal-equipped electric-wire is located in a rearward region of a corresponding one of the cavities 42. The rear region of the cavity 42 has an inner diameter slightly less than a maximum outer diameter of the sealing portion 32 of the water-proofing plug 30, so that the press-insertion of the water-proofing plug 30 into the rear region of the cavity 42 makes full surface contact between a maximum outer diameter region (outer peripheral surface) of the sealing portion 32 of the water-proofing plug 30 and the inner surface of the housing body 40A surrounding the cavity 42.

On the connector-equipped electric-wire bundle according to this embodiment will be assumed a situation where a tensile load be applied to the entire electric-wire bundle including the first electric wire 10A and the second electric wire 10B. In the case where an elongation of the first conductor 12A included in the first electric wire 10A is significantly less than an elongation of the second conductor 12B included in the second electric wire 10B, even a tensile load applied to the electric wires 10A and 10B evenly in an initial stage will be ultimately concentrated on the first conductor 12A; particularly on the portion onto which crimping is performed, thus promoting a breakage in the first conductor 12A. In other words, a tensile strength of the entire electric-wire bundle depends on a tensile strength of the first conductor; particularly, an electric-wire bundle having a first conductor 12A with a relatively small cross-sectional area can have only a significantly lowed tensile strength.

However, in the connector-equipped electric-wire bundle according to this embodiment, the intermediate crimp portion 27 included in the first connector terminal 20A attached to the first electric wire 10A improves a breaking elongation of the first electric wire 10A, thereby improving a tensile strength of the entire electric-wire bundle. Specifically, since the intermediate region 16 where the insulating cover 14 is exposed is ensured between the first conductor-exposed end and the water-proofing plug-attached portion of the first electric wire 10A, and the intermediate crimp portion of the first connecter terminal is crimped onto the insulating cover 14 in the intermediate region 16, directly (i.e., without interposing the water-proofing plug therebetween), the crimping of the intermediate crimp portion 27 restrains the tensile load from acting on the portion (conductor-crimped portion) where the first conductor barrels 26 is crimped onto the first conductor 12A, thus improving an elongation of the first electric wire 10A when it will have been broken in the crimped portion in the conductor. This improvement in breaking strength of the first electric wire 10A directly results in an improvement in tensile strength of the entire electric-wire bundle.

In other words, the intermediate barrels 27, directly crimped onto the insulating cover 14 having a hardness greater than that of the highly-flexible water-proofing plug 30 without interposing the water-proofing plug 30 therebetween differently from the water-proofing-plug barrels 28, can restrain a tensile load acting on the first electric wire 10A from being transmitted to the conductor-crimp portion more effectively than the water-proofing-plug barrels 28. This function of the intermediate barrels 27 makes the breaking elongation of the first electric wire be close to the breaking elongation of the second electric wire 10B, thus improving a tensile strength of the entire electric-wire bundle.

Meanwhile, for the second electric wire 10B originally having a relatively large breaking elongation, used is the low-cost second connector terminal 20B with no intermediate barrels 27; this allows cost of the entire connector-quipped electric-wire bundle to be reduced. In addition, setting the axial size of each of the conductor barrels 25 on the second electric wire 10B to be greater than that of each of the concoctor barrels 26 on the first electric wire 10A by the omitted intermediate barrels 27 enables the conductor barrels 25 to possess a retaining force enough to retain the second conductor 12B having a relatively large cross-sectional area, as mentioned above; furthermore, equalizing an axial overall length of the first connector terminal 20A and an axial overall length of the second connector terminal 20B to each other regardless of the presence or absence of the intermediate barrels 27 allows the axial size of the entire connector (that is, a size in a right and left direction in FIG. 1) to be shorten.

Although, in the above embodiment, each of the conductor-crimp portion, the water-proof plug-crimp portion and the intermediate crimp portion is formed as a single pair of right and left barrels, each of the crimp portions may be formed as a plurality of pairs of right and left barrels arranged side by side in a frontward-rearward direction.

EXAMPLE

There was performed a tensile rest on each of samples prepared by attaching the first connector terminal 20A (connector terminal having the three pairs of barrels 26, 27, 28) and the second connector terminal 20B (connector terminal having the two pairs of barrels 25, 28) to each of the following three types of electric wires 1, 2 and 3, to measure an elongation when breaking occurred (i.e., breaking elongation).

Conductor of Electric Wire 1: Soft copper (Cross-sectional area: 0.35 $mm^2$; Breaking elongation of electric wire itself: 20%)

Conductor of Electric Wire 2: Composite wire of a center elemental wire made of stainless steel and strand elemental wires made of copper (Cross-sectional area: 0.13 $mm^2$; Breaking elongation of electric wire itself: 18%)

Conductor of Electric Wire 3: Copper alloy containing 0.3% wt of Sn (Cross-sectional area: 0.13 $mm^2$; Breaking elongation of the electric wire by itself: 2%)

Each of the electric wires 1 to 3 has an overall length of 120 mm. The tensile test is performed by pulling each of the electric wires at a speed of 50 mm/min while chucking the electrical contact portion 22 of each of the connector terminals 20A and 20B and further chucking a region of the electric wire including the insulating cover, which region is away from an electric wire-crimp portion by 120 mm.

Figure 7:
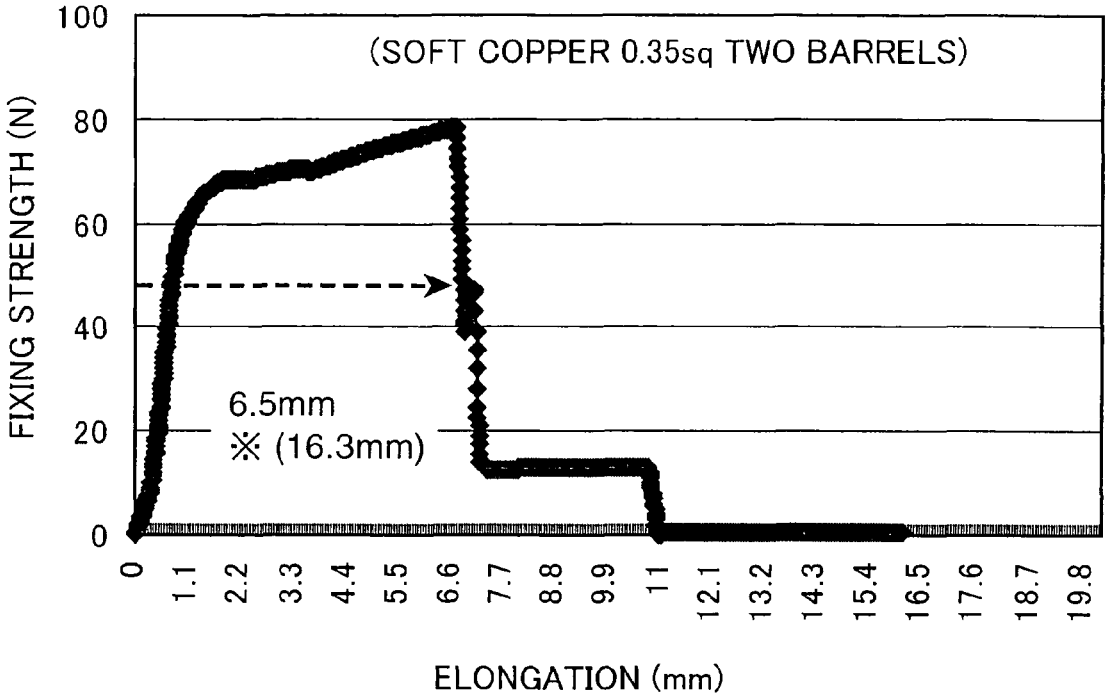
FIG. 7 is a graph showing a tensile test result on an electric wire 1 having a conductor made of soft cupper.
Figure 8A:
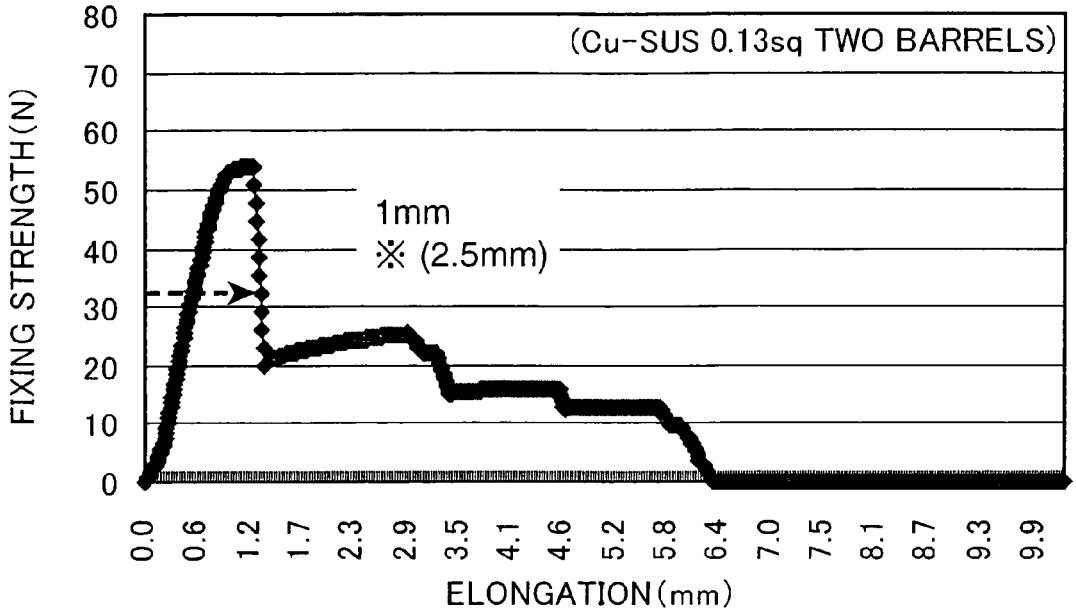
FIGS. 8A and 8B are graphs showing tensile test results on an electric wire 2 having a conductor formed of a composite wire.
Figure 8B:
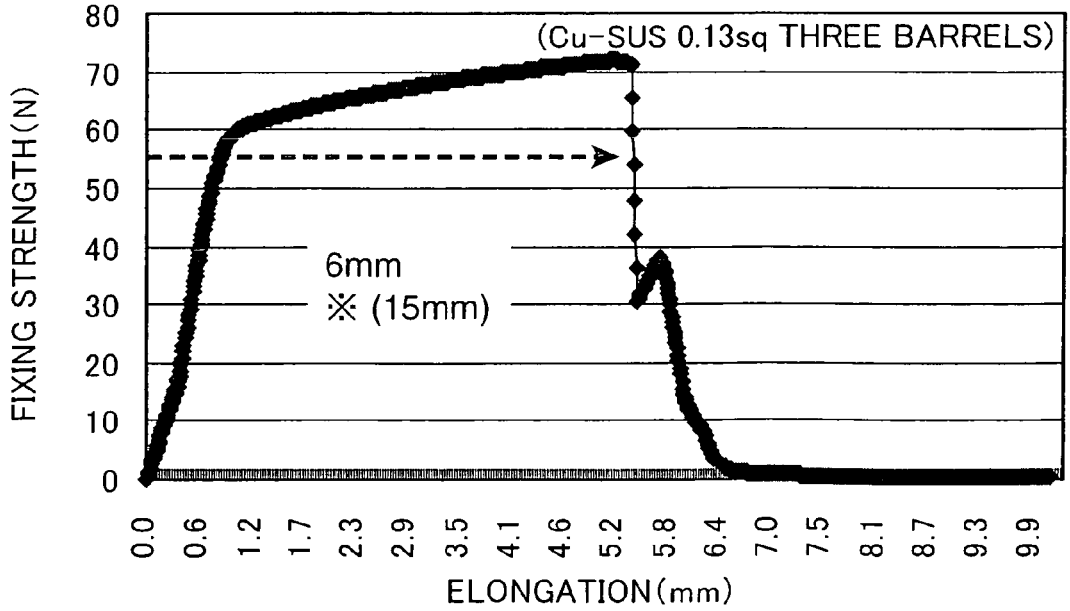
Figure 9A:
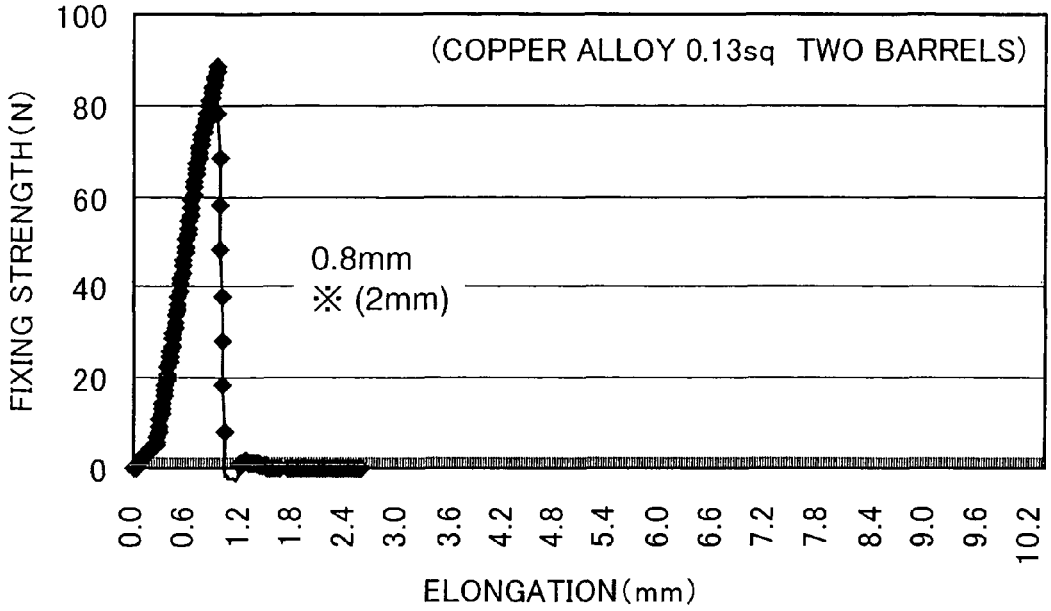
FIGS. 9A and 9B are graphs showing tensile test results on an electric wire 3 having a conductor made of copper alloy.
Figure 9B:
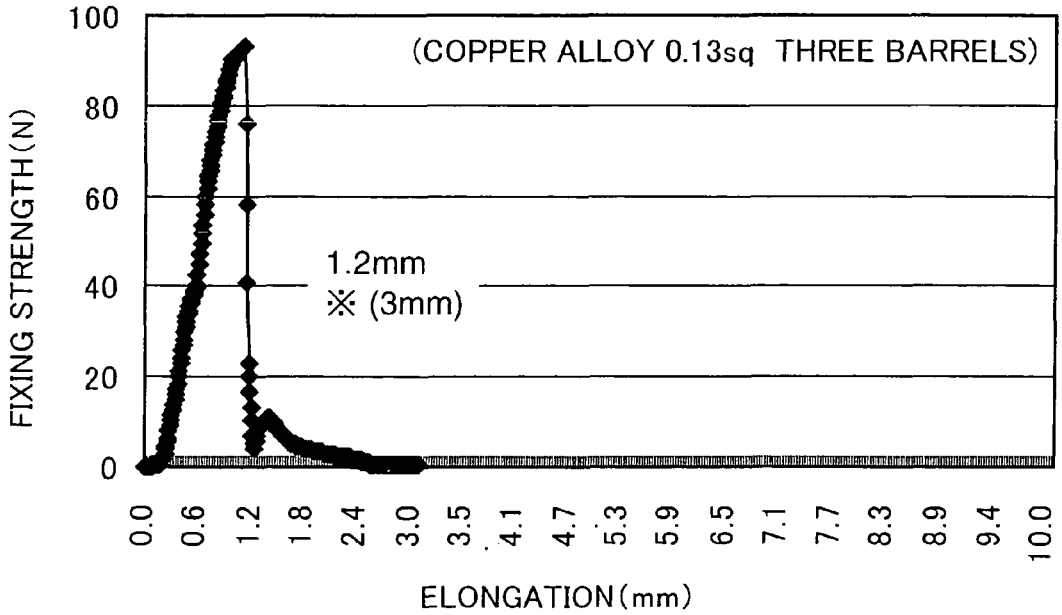

Results of the tensile test are shown in FIGS. 7 to 9. FIG. 7 shows a result on a sample where the second connector terminal 20B is attached to the electric wire 1. Similarly, FIG. 8A shows a result on a sample where the second connector terminal 20B is attached to the electric wire 2; FIG. 8B shows a result on a sample where the first connector terminal 20B is attached to the electric wire 2; FIG. 9A shows a result on a sample where the second connector terminal 20B is attached to the electric wire 3; and FIG. 9B shows a result on a sample where the first connector terminal 20B is attached to the electric wire 3.

As shown in FIG. 7, an breaking elongation of the sample where the second connector terminal 20B with the two barrels is attached to the electric wire 1 is 6.5 mm (its equivalent value in a 300 mm electric wire: 6.5 mm×300/120=16.3 mm), whereas breaking elongations of the samples where the second connector terminal 20B is attached to the electric wire 2 and the electric wire 3, are only 1 mm (its equivalent value in a 300 mm electric wire is 2.5 mm) and 0.8 mm (its equivalent value in a 300 mm electric wire is 2 mm), respectively, as shown in FIGS. 8A to 9A.

Overall lengths of electric wires used in a wire harness for vehicle generally varies within about 3 mm at a maximum, and the minimum of the overall lengths is about 300 mm. Accordingly, as to an electric-wire bundle including a specific electric wire having a breaking elongation of less than 3 mm as its equivalent value in a 300 mm electric wire as shown in FIGS. 8A and 9A, the specific electric wire with such a small breaking elongation, if being shorter than the remaining electric wires by 3 mm, may be broken before a tensile load acts on the remaining electric wires.

In contrast, in the case that the second connector terminal 20A with the three barrels is attached to the electric wire 2 and the electric wire 3, an breaking elongation of 3 mm or more as its equivalent value in a 300 mm electric wire can be generated as shown in FIGS. 8B and 9B, which gives a drastically enhanced tensile strength characteristic of the entre electric wire bundle.

As described above, the present invention provides a connector-equipped electric electric-wire bundle including a plurality of types of electric wires different in conductor cross-sectional area and elongation and being capable of maintaining a high tensile strength of the entire electric-wire bundle. Specifically, the water-proofing connector-quipped electric-wire bundle according to the present invention comprises: a plurality of electric wires each having a conductor and an insulating cover covering the conductor while being locally removed at an end of each of the electric wires; a plurality of water-proofing plugs each being made of material more pliable than the insulating cover at least in an periphery thereof and attached to a vicinity of the end of each of the electric wires so as to surround the insulating cover of the electric wire; a plurality of connector terminals each having a crimp portion crimped onto at least the end of each of the electric wires and the water-proofing plug attached to the electric wire; and a connector housing collectively holding the connector terminals while closely contacting peripheries of the water-proofing plugs onto which the respective connector terminals are crimped. The electric wires include a first electric wire having a first conductor and a second electric wire having a second conductor, the second conductor having a larger cross-sectional area and a greater elongation when the second conductor will have been broken under tensile load than a cross-sectional area and an elongation of the first conductor respectively. The connector terminals include a first connector terminal attached to the first electric wire and a second connector terminal attached to the second electric wire. The second connector terminal has, as the crimp portion, a second crimp portion including only a second-conductor crimp portion crimped onto the second conductor in the insulating cover-removed end of the second electric wire so as to enfold the second conductor and a water-proofing plug-crimp portion crimped onto the water-proofing plug attached to the second electric wire so as to enfold the water-proofing plug. The water-proofing plug is attached to the first electric wire at such a position that an intermediate region where the insulating cover is exposed is ensured between the insulating cover-removed end of the first electric wire and a portion of the first electric wire onto which the water-proofing plug is attached. The first connector terminal has, as the crimp portion, a first crimp portion including a first conductor-crimp portion crimped onto the first conductor in the insulating cover-removed end of the first electric wire so as to enfold the first conductor, a water-proofing plug-crimp portion crimped onto the water-proofing plug attached to the first electric wire so as to enfold the water-proofing plug, and an intermediate crimp portion crimped onto the insulating cover in the intermediate region of the first electric wire so as to enfold the insulating cover.

In the above electric-wire bundle, in spite that each of the cross-sectional area and the breaking elongation, which is an elongation occurring when the first conductor will have been broken under tensile load, of the first conductor constituting the first electric wire is less than a cross-sectional area and a breaking elongation, which is an elongation when the second conductor will have been broken under tensile load, of the second conductor constituting the second electric wire respectively, the intermediate crimp portion included in the first connector terminal attached to the first electric wire improves the breaking elongation of the first electric wire, thereby improving a tensile strength of the entire electric-wire bundle. In other words, equalization between the elongations of the respective electric wires enables the tensile strength of the entire electric-wire bundle to be improved with a low const structure.

Specifically, in the first electric wire, the intermediate region where the first conductor is exposed is ensured between the first conductor-exposed end and the water-proofing plug-attached portion of the first electric wire, the intermediate crimp portion of the first connecter terminal being crimped directly onto the insulating cover in the intermediate region (i.e., without interposing the water-proofing plug therebetween); this crimping onto the intermediate crimp portion suppresses a tensile load acting on a crimping portion (conductor-crimping portion) where the first conductor-crimp portion is crimped onto the first conductor, thus improving an elongation when a breakage will have occurred in the conductor-crimp portion (breaking elongation) of the first electric wire. This improvement in breaking strength of the first electric wire directly results in an improvement in tensile strength of the entire electric-wire bundle.

In other words, the intermediate crimp portion, being crimped, in the intermediate region, directly onto the insulating cover harder than the highly-pliable water-proofing plug, can effectively restrain a tensile load acting on the first electric wire from being transmitted to the crimp portion of the conductor, as compared with a portion where the water-proofing plug-crimp portion is crimped onto the water-proofing plug. This allows the breaking elongation of the first electric wire and further a tensile strength of the entire electric-wire bundle to be significantly improved.

Meanwhile, for the second electric wire originally having a relatively large breaking elongation, used is the second connector terminal which has, as the crimp portion, only the conductor-crimp portion and the water-proofing plug crimp portion (i.e., the intermediate crimp portion is omitted); this brings about a reduction in cost of the entire connector-quipped electric-wire bundle.

Furthermore, the omission of the intermediate crimp portion in the second connector terminal permits an axial size of the second conductor-crimp portion to be set greater than that of the first conductor-crimp portion. Thus setting the size increases a retaining force, by the second conductor-crimp portion, to retain the second conductor having a relatively large cross-sectional area, while promoting equalization between an axial overall length of the first connector terminal having the intermediate crimp portion and an axial overall length of the second connector terminal. For example, an axial overall length of the first connecter terminal and an axial overall length of the second connection terminal can be set to be equal to each other, which permits the axial size of the entire connector to be shortened.

As the first conductor can be used, for example, a high-tensile strength conductor formed of a plurality of elemental wires, at least a part of which elemental wires is made of material, such as stainless steel, having a tensile strength greater than that of material of the second conductor. Such a high-tensile strength conductor has a breaking elongation significantly less than that of a commonly-used conductor material (such as copper); therefore, attaching the first connector terminal with the intermediate crimp portion to the first electric wire having the high-tensile strength conductor is significantly effective in an improvement of a tensile strength of the entire electric-wire bundle. This effect is remarkable particularly in the case of the second conductor made of copper having a large breaking elongation.

The invention claimed is:

1. A water-proofing connector-quipped electric-wire bundle comprising:

a plurality of electric wires each having a conductor and an insulating cover covering the conductor, the insulating cover being locally removed at an end of each of the electric wires;

a plurality of water-proofing plugs each made of material which is more pliable than the insulating cover, at least in an periphery thereof, and attached to a vicinity of the end of each of the electric wires so as to surround the insulating cover of the electric wire;

a plurality of connector terminals each having a crimp portion crimped onto at least the end of each of the electric wires and the water-proofing plug attached to the electric wire; and a connector housing collectively holding the connector terminals while making in close contact with the peripheries of the water-proofing plugs onto which the respective connector terminals are crimped, wherein:

the electric wires include a first electric wire having a first conductor, and a second electric wire having a second conductor with a greater cross-sectional area and a greater breaking elongation occurring when the second conductor will have been broken under tensile load than a cross-section area and a breaking elongation of the first conductor respectively; and the connector terminals include a first connector terminal attached to the first electric wire and a second connector terminal attached to the second electric wire, and wherein:

the second connector terminal has, as the crimp portion, a second crimp portion which comprises only a second conductor-crimp portion crimped onto the second conductor in the insulating cover-removed end of the second electric wire so as to enfold the second conductor and a water-proofing plug-crimp portion crimped onto the water-proofing plug attached to the second electric wire so as to enfold the water-proofing plug;

the water-proofing plug is attached to the first electric wire at such a position that an intermediate region where the insulating cover is exposed is ensured between the insulating cover-removed end of the first electric wire and a portion of the first electric wire to which the water-proofing plug is attached; and the first connector terminal has, as the crimp portion, a first crimp portion which includes a first conductor-crimp portion crimped onto the first conductor at the insulating cover-removed end of the first electric wire so as to enfold the first conductor, a water-proofing plug-crimp portion crimped onto the water-proofing plug attached to the first electric wire so as to enfold the water-proofing plug, and an intermediate crimp portion crimped onto the insulating cover in the intermediate region of the first electric wire so as to enfold the insulating cover.

2. The water-proofing electric-wire bundle as defined in claim 1, wherein an axial size of the second conductor-crimp portion is greater than an axial size of the first conductor-crimp portion.

3. The water-proofing electric-wire bundle as defined in claim 2, wherein an axial overall length of the first connector terminal and an axial overall length of the second connector terminal are equal to each other.

4. The water-proofing electric-wire bundle as defined in claim 1, wherein the first conductor comprises a plurality of elemental wires, at least a part of the elemental wires being made of material having a tensile strength greater than that of material of the second conductor.

5. The water-proofing electric-wire bundle as defined in claim 4, wherein the first conductor includes an elemental wire made of stainless steel.

6. The water-proofing electric-wire bundle as defined in claim 4, wherein the second conductor is made of copper.

7. The water-proofing electric-wire bundle as defined in claim 5, wherein the second conductor is made of copper.

* * * * *